United States Patent [19]

Odet et al.

[11] Patent Number: 4,795,043

[45] Date of Patent: Jan. 3, 1989

[54] CAP FOR CONTAINER INITIALLY CLOSED BY A FRANGIBLE LID

[75] Inventors: Philippe Odet, Chasselay; Jean P. Agati, Lyon, both of France

[73] Assignee: Astra Plastique, Saint-Georges-de-Reneins, France

[21] Appl. No.: 117,266

[22] Filed: Nov. 6, 1987

[30] Foreign Application Priority Data

Nov. 6, 1986 [FR] France ..... 86 16028
Aug. 4, 1987 [FR] France ..... 87 11235

[51] Int. Cl.[4] ..... B65D 41/34

[52] U.S. Cl. ..... 215/235; 215/250; 215/252; 222/83

[58] Field of Search ..... 215/226, 250, 257, 228, 215/235, 237, 252; 220/258, 277, 278; 222/83; 221/31

[56] References Cited

U.S. PATENT DOCUMENTS 3,406,872 10/1968 Fiquet et al. ..... 222/83

FOREIGN PATENT DOCUMENTS 616408 7/1935 Fed. Rep. of Germany .
1117703 3/1956 France ..... 222/83
1479110 3/1967 France .

*Primary Examiner*—Donald F. Norton
*Attorney, Agent, or Firm*—Browdy and Neimark

[57] ABSTRACT

A cap for covering a container, the opening of which is initially blocked by a sealed lid. The bottom of the cap is provided with a deformable part provided with a perforation means. A deformable part initially occupies a position in which the perforation means is maintained at a distance from the lid. At the moment of first use of the contianer, the deformable part is lowered to a position in which the perforation means penetrates the plane of the lid. The configuration can be used with screw-on caps, particularly with caps having tamperproof bands, or with hinged caps.

12 Claims, 4 Drawing Sheets

CAP FOR CONTAINER INITIALLY CLOSED BY A FRANGIBLE LID

The present invention, relating to the field of packaging of products, particularly liquid, viscous or pasty products, such as food or medical products, relates to a cap intended for a container receiving these types of products. The cap has an opening which, initially, is hermetically sealed by a lid sealed on the edge of the opening, the lid having to be perforated or torn at the time of the first use.

BACKGROUND OF THE INVENTION

Such containers, made of plastic, are now used in the dairy industry, more particularly for packaging sterilized milk.

Containers of this type now available on the market have a number of drawbacks.

In particular, protection of the lid from the risks of deterioration or accidental perforation is insufficient. Obviously these risks exist during the various handlings which take the container from its place of filling to the consumer's table, passing through the place of sale. A poor guarantee of the product packaged in the container results.

Moreover, the container should be opened with a cutting or perforating object, used to strike and/or tear the lid to free the opening or a pouring orifice. The cut thus made remains inexact and irregular and does not facilitate use of the container.

Finally, if the contents of the container are not used at one time, after tearing of the lid there is no protection for the product remaining in the container, the container remaining open since no possibility of recapping is offered to the user.

SUMMARY OF THE INVENTION

The present invention aims at remedying all these drawbacks by providing for the containers of the type considered here, and for other similar containers, a closing system which assures an initial protection before the first use of the container. This system permits a sharp and exact opening by perforation of the lid without the aid of an outside tool, and permits a tight recapping of this container after the first use if its contents are not use at one time. The proposed system is simple in structure and use, and therefore is economical. The system can be applied to caps of various types, since it is suitable both for screw-on caps and hinged caps.

For this purpose, the invention has as its object a cap for a container initially closed by a frangible lid, particularly a lid sealed on the edge of an opening of the container, with, on a bottom of this cap, a deformable part provided with a perforation means directed toward the container. A cap in which the deformable part, provided with a perforation means, is provided, on the one hand, initially to occupy a stable position in which it is raised relative to the rest of said bottom and in which the perforation means is kept at a distance from the lid when the cap is in closed position, and, on the other hand, can be brought, at the moment of first use of the container, to another stable position in which this deformable part is sunk lower than the rest of said bottom and in which, the perforation means being lowered, goes through the plane of the lid.

Thus there is available, up to the moment of use of the container, a capping which covers and protects the lid, the perforation means being kept above the plane of this lid. At the moment of use, a thrust exerted by the finger on the deformable part of the bottom of the cap causes the perforation of the lid.

In a preferred embodiment of the invention, the deformable part of the circular bottom of the cap comprises a relatively rigid plate, whose edge is fastened by a thin web forming a hinge, to a relatively rigid inclined wall which is fastened, by another thin web forming a hinge, to the rest of the bottom, the perforation means being formed under the plate which, initially, is raised relative to the rest of the bottom and which, after being sunk, is located below the rest of the bottom. The difference in level between the two thin webs forming hinges is determined to correspond to the half of the travel necessary for the perforation means, starting from its initial position, to go through the plane of the lid.

The deformable part constituting, before use of the container, an elevation above the bottom, the cap according to the invention also advantageously comprises protective means which go beyond this bottom and which surround the deformable part, these means having a height equal to or greater than the protrusion of the deformable part above the rest of the bottom in its initial position. Thus protective means are available which avoid any accidental and premature sinking of the deformable part, particularly in case of stacking of the containers. The protective means can consist of a flange formed on the periphery of the bottom and having a height equal to or greater than the protrusion of the deformable part above the bottom in its initial position.

In case the cap is in the form of a screw-on cap, the deformable part provided with the perforation means is preferably provided in off-center position on a bottom solid with a cylindrical outside jacket with an inside thread for screwing onto the neck of the container whose opening is initially blocked by the lid. The outside skirt comprises at its base a tamperproof band held by sectionable tabs and provided on the inside with reverse-lock notches, so that after sinking of the deformable part and tearing away of the tamperproof band, unscrewing of the cap makes it possible to cut of the lid in an arc by the off-center perforation means.

Thus, after tearing away of the tamperproof band and in a first phase of unscrewing of the cap, the off-center perforation means intervenes like a cutting blade to cut the lid in an arc before going above the plane of the lid. When the cap is entirely unscrewed, the lid can be torn away to permit pouring of the contents of the container. If the container is to be reused, it suffices to screw the cap back on the neck of the container to close the latter. The combination of the tamperproof band and the irreversibility of the sinking of the deformable part constitutes an excellent guarantee of the previous nonuse of the container for the consumer.

The cap, which is the object of the present invention, can also be in the form of a hinged cap with a body able to fit the neck of a container. The body has a bottom provided with a pouring or distributing orifice, and a covering connected in an articulated manner to the body by a hinge which can occupy a closed or open position. The covering comprises a skirt connected to a bottom; in this case, the deformable part provided with the perforation means belongs to the bottom of the covering and is placed, on this bottom, in a position corresponding to that of the pouring or distributing orifice of the body of the cap. In this embodiment, sinking of the deformable part is performed when the covering is in a closed position, and causes the perforation of the lid opposite the pouring or distributing orifice. Then, opening of the covering allowed by the hinge frees this orifice and permits pouring or distribution of the contents of the container. If this container is to be reused, it suffices to reclose the covering to recap the pouring orifice.

Advantageously, the perforation means has a contour corresponding to that of the pouring orifice of the body, and it is provided so that, when the covering is in closed position and after sinking of the deformable part, this perforation means is applied in a tight manner against the edge of the pouring orifice. The perforation means comprises, at its end turned toward the container, an edge with cutting parts, preferably inclined. Thus, on the one hand, a perforation of the lid is obtained which is sharp and which follows exactly the contour of the pouring orifice and, on the other hand, a tight blocking of this orifice during recapping. According to a complementary characteristic, the pouring or distributing orifice is surrounded by a flange against which the perforation means is applied when the covering is closed position and after sinking of the deformable part; the flange of the orifice contributes not only to the sealing but also to the use of the container, by serving for spreading of the distributed product, in the case of a viscous or pasty product.

In any case, the cap can be made in one piece, of molded plastic, with its deformable part provided with the perforation means. This cap particularly can be made of polypropylene, which is sufficiently rigid for the elements assuring the perforation of the lid while having excellent elastic properties essential for the good functioning of the thin webs of the deformable part, forming hinges. The elasticity of the deformable part contributes to the good perforation by creating a percussion effect on the lid. Further, this embodiment makes it possible to use the invention for a hinged cap whose hinge comprises, in a way known in the art a part with spring action.

BRIEF DESCRIPTION OF THE DRAWINGS

In any case, the invention will be better understood with the help of the following description, with reference to the accompanying diagrammatic drawings, representing, as nonlimiting examples, some embodiments of the protective cap for a container closed by a perforable lid, in which:

FIG. 3 is a view in section similar to FIG. 2, but showing a perforation of the lid, the deformable part being driven in;

DETAILED DESCRIPTION OF THE INVENTION

Figure 1:
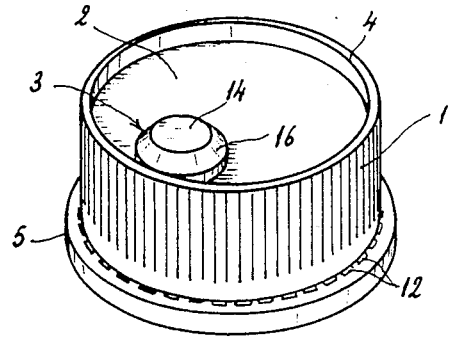
FIG. 1 is a general view, in perspective, of a screw-on protective cap according to the invention.

The first embodiment of the cap according to the present invention is shown in FIGS. 1 through 5. This embodiment comprises a cylindrical exterior skirt 1, at the top of which is a circular bottom 2 including a deformable part 3. The external skirt is extended at the top thereof by a small flange 4, and, at the base, by a tamperproof band 5.

Figure 2:
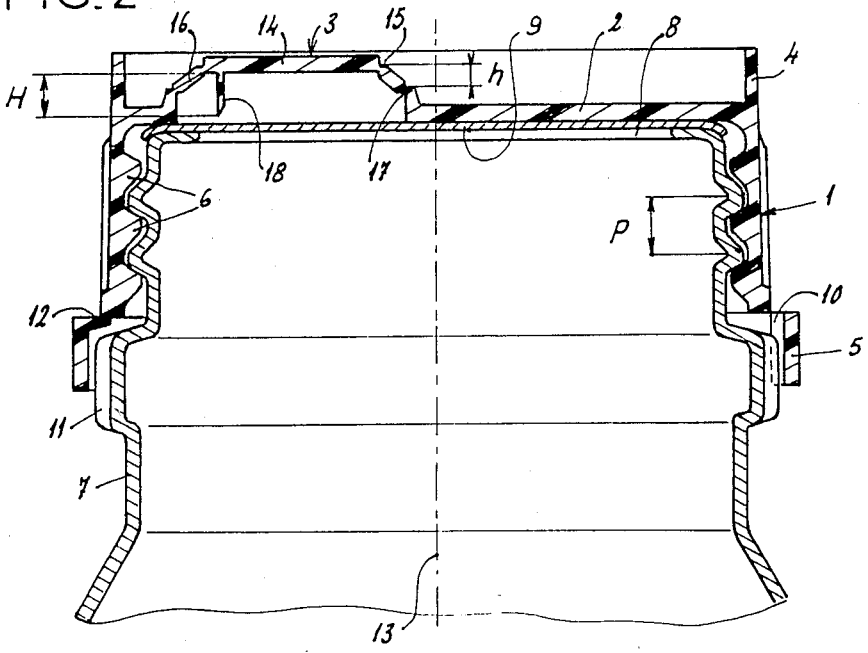
FIG. 2 is a view in section going through the axis of the screw-on cap of FIG. 1, represented placed on the neck of a bottle, with hinge, with a relatively rigid tapered lateral wall.
Figure 3:
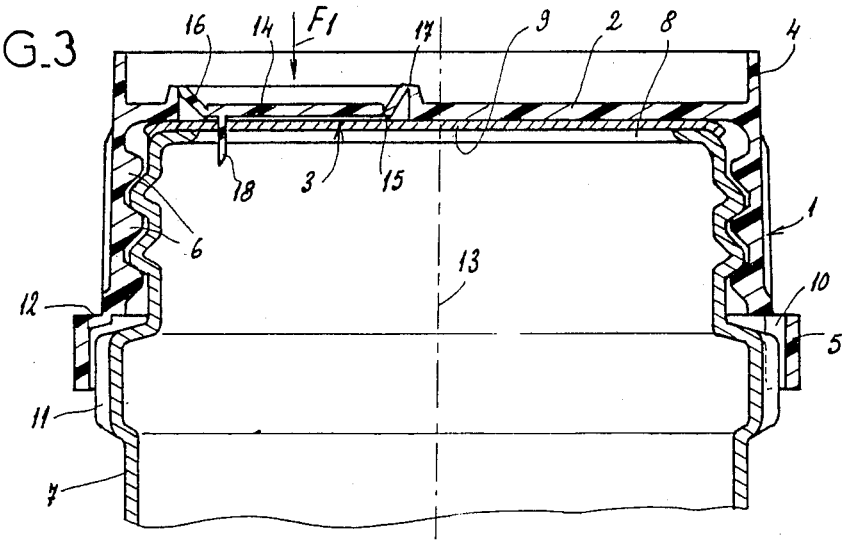
Figure 4:
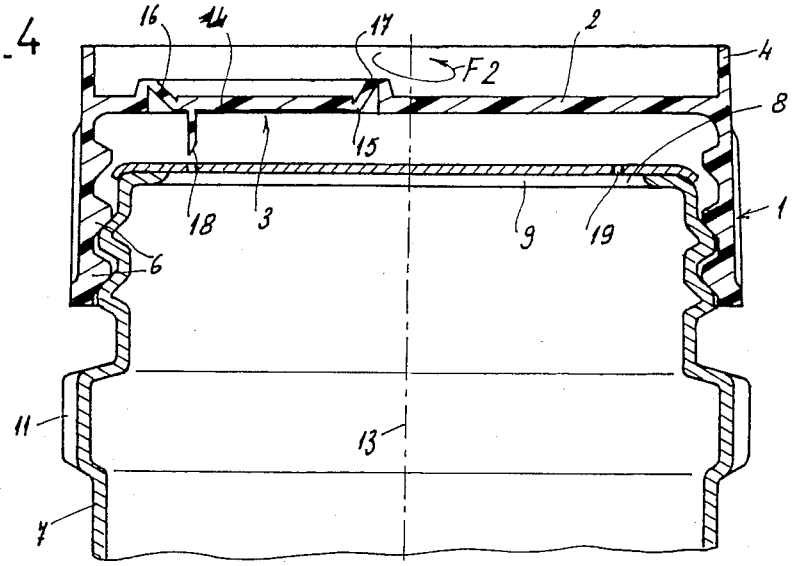
FIG. 4 is another section similar to the preceding drawing, showing the cap in a position of being unscrewed, after perforation of the lid.
Figure 6:
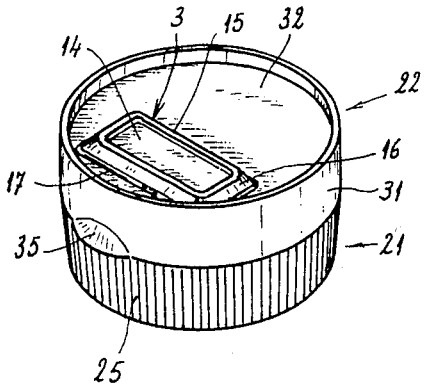
FIG. 6 is a perspective view of an articulated cap according to the present invention, in closed portion.
Figure 7:
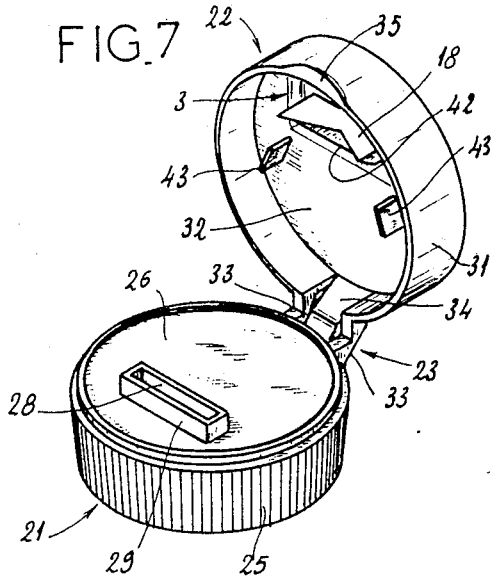
FIG. 7 is a perspective view of the cap of FIG. 6, in the open position.

As shown in FIGS. 2 through 4, the exterior cylindrical skirt 1 includes interior threads 6, enabling the cap to be screwed onto the collar 7 of a plastic container. The opening 8 is initially covered by a lid 9, comprising an aluminum-polyethylene laminate, which is heat-sealed around the edge of the opening 8. The tamperproof band 5 is provided with notches 10 which prevent reversal, which reverse lock notches are engaged by a set of teeth 11 on the collar 7 of the container. The tamperproof band 5 is attached at the base of the skirt 1 by sectional tabs 12.

Figure 5:
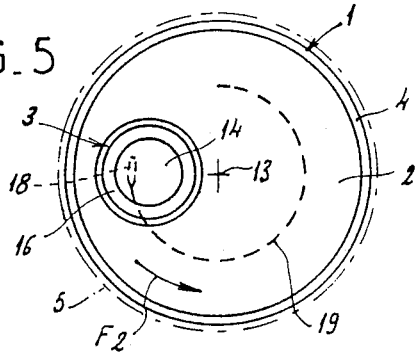
FIG. 5 is a plan view of the cap, indicating the cutout form during the course of unscrewing the cap.

The deformable part 3 of the circular bottom 2, which is also shown in FIG. 5, occupies an outlying position with regard to the general axis 13 of the cap. This deformable part 3 includes a thin circular plate 14 which is relatively rigid, which plate lies parallel to the remainder of the bottom 2. The circular border of the plate is attached by a thin web 15 forming a hinge, at a relatively thick inclined wall. The inclined wall itself is attached by another web 17 which forms a hinge, at the remainder of the bottom 2.

Under plate 14 projects a perforation and cutting blade 18, turned toward the inside of the container. Blade 18 can exhibit a shape slightly curved as an arc, whose center of curvature is located approximately on general axis 13 of the cap. Height H of blade 18 is slightly below pitch P of inside thread 6 of outside skirt 1.

Initially, plate 14 is raised relative to the rest of bottom 2, thin web 15 being located higher than the other thin web 17, the difference in level between these two webs 15 and 17 being indicated by h in FIG. 2. It is noted that flange 4 has such a height that its upper edge is located at the level of the upper face of plate 14, or slightly higher than this upper face. Flange 4 thus provides protection, by avoiding any undesirable thrust on plate 14, particularly in case of stacking of the containers. In this initial position, blade 18 remains separated from lid 9, the lower edge of blade 18 being located a little above the plane of lid 9.

During a first use of the container, a downward thrust is exerted by the finger on plate 14, as indicated by arrow Fl in FIG. 3. Thanks to the flexibility of the two thin webs 15 and 17, the entire deformable part 3 is then "reversed," i.e., starting from a convex shape it becomes concave, plate 14 finally being lowered relative to the rest of bottom 2, thin web 15 coming lower than the other thin web 17. Blade 18, accompanying plate 14 in its descending movement, then comes to perforate lid 9, the travel of blade 18 being equal to double height h, which is determined so that perforation of lid 9 by blade 18 is obtained.

Cap being unscrewed as indicated by arrow F2 in FIGS. 4 and 5, after breaking of tabs 12 connecting it to the tamperproof band, blade 18, during the first turn of cap, makes an arc-shaped cut 19, centered on general axis 13.

The cap being lifted at the same time that it turns, blade 18 continues to cut lid 9 during unscrewing until the instant when this blade 18 again passes entirely above the plane of lid 9. Considering the relation between height H of blade 18 and pitch P of thread 6, the blade makes a cut 19 on the lid over about ¾ of a turn, thus leaving an uncut zone, as shown in FIG. 5, so that central part of lid 9 remains attached to its sealed peripheral part. After cut 19 is made, unscrewing of the cap is completed without intervention of blade 18, as shown in FIG. 4, until the cap can be removed.

The cut central part of lid 9 is then torn away entirely, and the container can be used, its contents being poured out by opening 8. The cap can then be rescrewed onto neck 7, and be used as long as it is desired to close the container.

FIGS. 6 to 9 represent another cap made up mainly of a body 21, a covering 22, a hinge 23 connecting covering 22 in an articulated manner to body 21.

Body 21 of the cap, provided to fit on neck 24 of a flexible or rigid container such as a flask (see FIGS. 8 and 9), comprises a cylindrical skirt 25 whose top is connected to a circular bottom 26. On the inside, skirt 25 comprises a thread 27 making possible holding of the cap by screwing on neck 24 of the container. Bottom 26 exhibits a pouring orifice 28 of elongated rectangular shape, off-center in position, which is surrounded by a flange 29 turned toward the outside, making it possible to spread the product contained in the container. The outside face of cylindrical jacket 25 can exhibit a knurling.

A frangible lid 9, made of an aluminum-polypropylene complex, is put in place at the top of neck 24 of the container, the lid being pressed by its edge between bottom 26 of body 21 of the cap and the top of neck 24, at the moment of screwing of the cap. An induction welding assures total immobilization of body 21 and lid 9 relative to neck 24.

Covering 22 of the cap comprises a cylindrical jacket 31 connected to a circular bottom 32. Hinge 23, connecting skirt 31 of covering 22 to body 21, is formed here by two lateral connecting lugs 33, placed on both sides of a connecting tongue 34. Each of lateral lugs 33 has a thinned central part forming a film hinge, while connecting tongue 34, also provided with thinned zones, achieves a spring effect. The lower edge of skirt 31 is provided to catch slightly on the top of body 21 of the cap to hold covering 22 in closed position. Skirt 31 also comprises, in a position diametrically opposite to hinge 35, a small nose 33 making it possible to lift covering 22 by a finger to bring it into open position.

According to the invention, the bottom 32 of covering 22 comprises, in a position corresponding to that of pouring orifice 28, a deformable part 3 which can perforate the lid. Deformable part 3 comprises a relatively thick and rigid plate 14, of elongated rectangular shape, whose edge is attached by a first thin web 15 forming a hinge to a relatively thick and rigid inclined lateral wall 16. Lateral wall 16 is attached, by a second thin web 17 forming a hinge, to the rest of bottom 32 of covering 22.

Under plate 14 projects a perforation hollow element 18, whose position and contour correspond to those of pouring orifice 28, lower edge 42 of this perforation element 18 being cutting and preferably exhibiting inclined parts.

Two lugs 43, forming stops, also project under bottom 32 of covering 22, behind deformable part 3.

Figure 8:
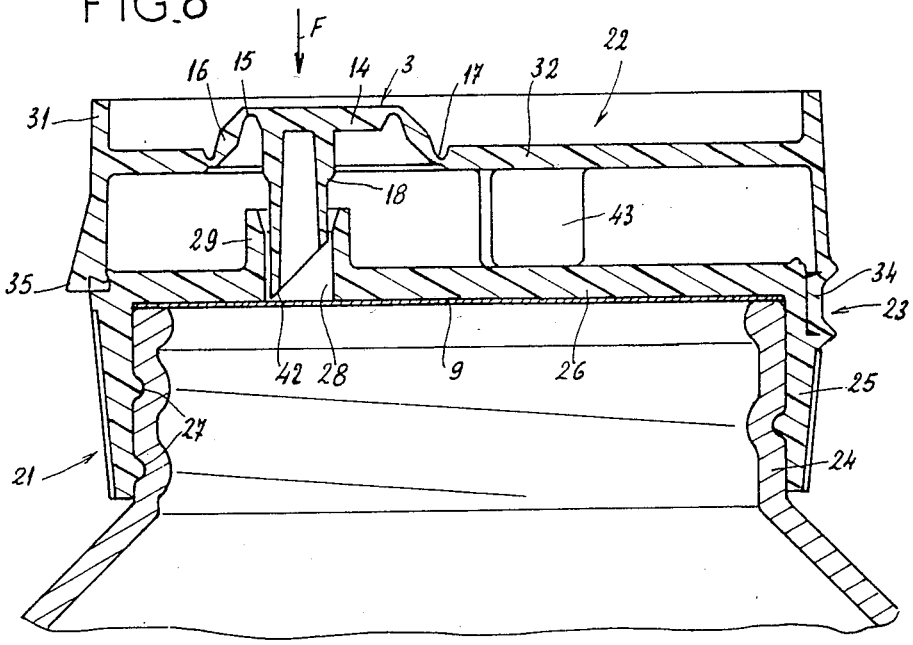
FIG. 8 is a sectional view of a screw cap, in place on the neck of a container, shown in the initial closed portion after perforating the lid, and also showing the closed position, i.e., before opening the cap.

Initially, as FIG. 8 shows, covering 22 of the cap is in the closed position, and plate 14 of deformable part 3 is raised relative to the rest of bottom 32, first thin web 15 being located higher than second thin web 17. Perforation element 18 is then partially engaged in pouring orifice 28, lower edge 42 of this element 18 being located some tens of millimeters above lid 9. Lugs 43, resting on the bottom 26 of body 21, prevent any undesirable sinking of bottom 32 of covering 22. An additional security is also obtained by extending skirt 31 above bottom 32 of covering 22, over a height at least equal to the initial protrusion of deformable part 3 above bottom 32.

During first use of the container, a downward thrust F is exerted by the finger on plate 14. Thanks to the flexibility of the two thin webs 15 and 17, the entire deformable part 3 is then "reversed," i.e., starting from a convex shape it becomes concave.

Figure 9:
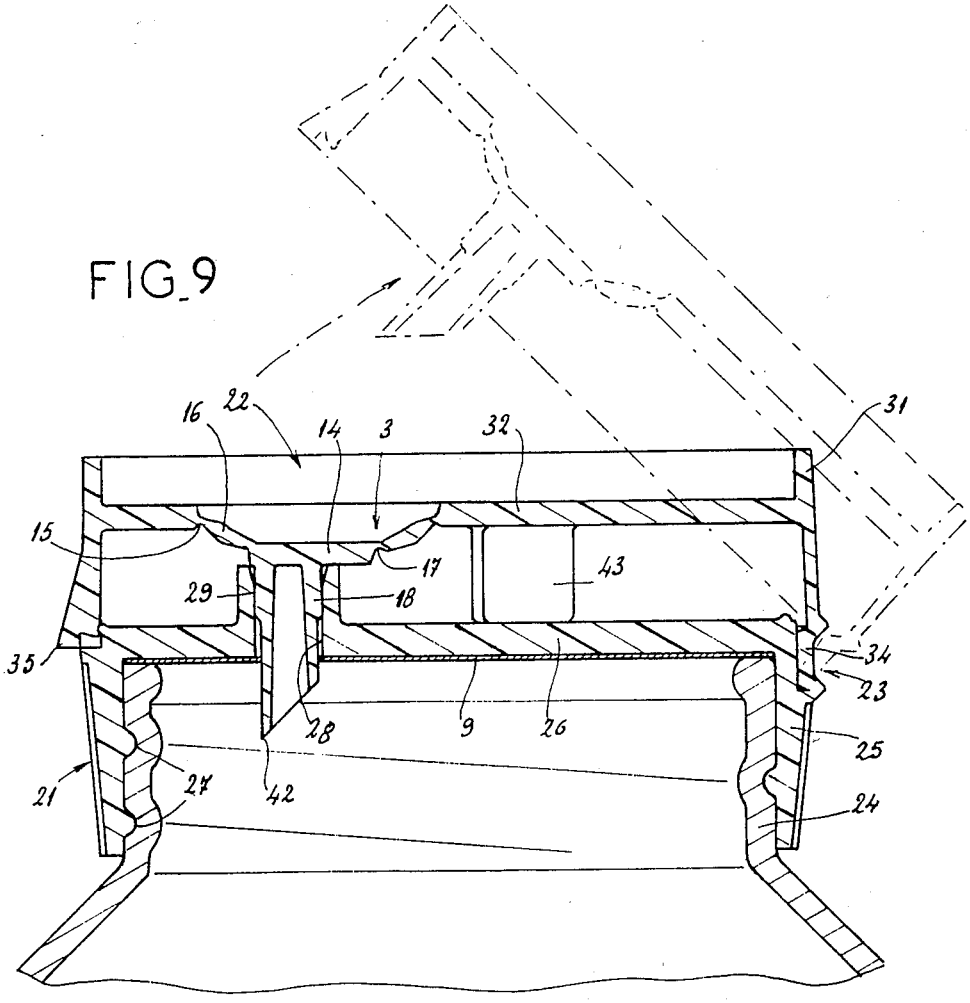
FIG. 9 is a sectional view similar to FIG. 8, showing the cap in closed portion after perforation of the lid, and also showing the open portion of the cap.

As FIG. 9 shows, plate 14 is finally lowered relative to the rest of bottom 32, first thin web 15 coming lower than second thin web 17. Perforation element 18, accompanying plate 14 in its descending movement, is sunk into orifice 28 and, by its lower edge 42, comes several millimeters below the plane of lid 9 after having struck and perforated this lid 9.

After perforation of lid 9, opening of covering 22 (as indicated by the mixed line of FIG. 9) makes it possible to use the container, the contents of the latter being able now to leave by pouring orifice 28.

Closing of covering 22 brings back deformable part 3 and perforation element 18 to pouring orifice 28, and more particularly against flange 29 of this orifice 28, into such a position that this orifice 28 is blocked in a tight manner.

In any case, the cap can be made one piece by molding of a suitable synthetic material such as polypropylene. Generally, this protective cap can be applied to various containers: bottles, flasks, cans initially closed by a perforable lid, and able to contain a liquid or any other product, particularly in the field of the food and pharmaceutical industry. The hinged cap according to FIGS. 6 to 9 is more particularly able to fit neck 24 of a flexible container, whose walls can be pressed to make its contents comes out through orifice 8, this hinged lid applying particularly to blocking of flexible containers for viscous or pasty products, used, for example, in the field of packaging of food products or maintenance products for household use, flange 29 of pouring orifice 28 serving to spread the product to be distributed.

What is claimed is:

1. A cap for a container closed by a frangible lid sealed on the edge of the opening of the container, the cap having a bottom having a first portion and a second portion, said first portion comprising a deformable part comprising a relatively rigid plate;

said deformable part provided with a perforation means directed toward the container;

said deformable part initially occupies a stable position raised relative to said bottom;

said perforation means being maintained at a distance from said lid when the cap is in a closed position;

said perforation means during use of the container being brought to a position wherein the deformable part is sunk lower than the second portion of said bottom, and when the perforation means is lowered, the perforation means penetrates the plane of the lid;

a thin web forming a hinge fastens an edge of said plate to one edge of a relatively thick inclined wall;

a thin web forming a hinge fastens a second edge of said wall to the second portion of said bottom;

wherein said perforation means is formed under said plate which initially is raised relative to the remainder of the bottom and which, after being lowered, is located below the second position of the bottom.

2. The cap according to claim 1, wherein the two thin webs are disposed one with respect to the other such that the difference in level h between the two thin webs forming hinges corresponds to half of the distance necessary for the perforation means, beginning in its initial position, to penetrate the plane of the lid.

3. The cap according to claim 1, further including protective means disposed so as to surround said bottom;

said protective means having a height equal to or greater than the protrusion of said deformable part above the second portion of said bottom in its initial position.

4. The cap according to claim 3, wherein the protective means comprises a flange formed on the periphery of the bottom;

said flange having a height equal to or greater than the protrusion of deformable part above the second portion of said bottom in its initial position.

5. The cap according to claim 1, wherein the cap is a screw-on cap and said deformable part provided with perforation means is provided in an off-center position on said bottom integral with a cylindrical outside jacket, and further comprising:

an inside thread provided on an inside portion of said jacket for screwing the cap onto the neck of a container;

an opening in said container which is initially covered by a lid;

said outside jacket comprising at its base a tamperproof band held in place by sectional tabs, and reverse-lock notches provided on an inside surface of said tamperproof band;

whereby after penetration of said deformable part into said plane of said lid and tearing away of said tamperproof band, unscrewing of the cap permits cutting of the lid in an arc by the off-center perforation means.

6. The cap according to claim 5, wherein the height H of the perforation means is slightly less than pitch P of the inside thread of the outside skirt.

7. The cap according to claim 1, wherein:

said cap comprises a hinged cap and a body which fits a neck of a container, said body comprising a bottom surface provided with a pouring orifice;

said neck of the container is initially covered by the lid;

a covering is connected in an articulated manner to said body by a hinge;

said covering is capable of occupying a closed or open position;

first covering comprises said bottom having the first and second portion and a skirt connected to the bottom; and said deformable part placed on said bottom in a position corresponding to that of the pouring orifice of the body of the cap.

8. The cap according to claim 7, wherein said perforation means has a contour corresponding to that of the pouring orifice of said body;

said perforation means provided so that, when the covering is in closed position and after penetration of the plane of the lid by said deformable part, said perforation means is applied in a tight manner against an edge of said pouring orifice.

9. The cap according to claim 8, wherein said perforation means further includes an edge with cutting parts.

10. A hinged cap according to claim 8, wherein said pouring orifice is surrounded by a flange against which said perforation means is applied when said covering is in a closed position and after penetration of the plane of the lid by the deformable part.

11. The hinged cap according to claim 7, wherein lugs forming stops in the closed position of said covering are formed under the bottom of said covering.

12. The hinged cap according to claim 11, wherein said cap is made of one piece molded plastic including said deformable part provided with said perforation means.

* * * * *